US007100332B2

(12) United States Patent
Loesch

(10) Patent No.: US 7,100,332 B2
(45) Date of Patent: Sep. 5, 2006

(54) UNFOLDING MODULAR BUILDING SYSTEM

(76) Inventor: Ivan L. Loesch, 265 13th St., Huron, SD (US) 57350

( * ) Notice: Subject to any disclaimer, the term of this patent is extended or adjusted under 35 U.S.C. 154(b) by 0 days.

(21) Appl. No.: 10/926,349

(22) Filed: Aug. 26, 2004

(65) Prior Publication Data

US 2006/0053701 A1 Mar. 16, 2006

(51) Int. Cl.
*E04H 1/00* (2006.01)

(52) U.S. Cl. ..... 52/79.5; 52/69; 52/143; 52/270; 52/645

(58) Field of Classification Search ..... 52/630, 52/79.5, 67, 79.1, 68, 143, 234, 122.1, 641, 52/69, 284, 270, 90.1, 93.1, 645, 646, 653.1; 206/321; 224/1.5
See application file for complete search history.

(56) References Cited

U.S. PATENT DOCUMENTS 1,100,273 A * 6/1914 Wiard ..... 52/63
1,285,467 A * 11/1918 Thiessen ..... 52/71
2,293,569 A * 8/1942 Sonion ..... 52/71
2,765,498 A * 10/1956 Kelnhofer ..... 52/70
2,883,713 A * 4/1959 Zug ..... 52/71
3,348,344 A * 10/1967 Tatevossian ..... 52/22
3,983,665 A * 10/1976 Burton ..... 52/71
4,471,586 A * 9/1984 Shuch et al. ..... 52/36.2
4,534,141 A 8/1985 Fagnoni
4,633,626 A * 1/1987 Freeman et al. ..... 52/71
4,672,779 A * 6/1987 Boyd ..... 52/79.4
5,167,575 A * 12/1992 MacDonald ..... 454/187
5,293,725 A * 3/1994 Matticks et al. ..... 52/271
5,447,000 A 9/1995 Larson
5,596,844 A * 1/1997 Kalinowski ..... 52/79.5
5,765,316 A 6/1998 Kavarsky
5,906,075 A * 5/1999 Sowers ..... 52/79.8
5,950,373 A 9/1999 von Hoff et al.
6,192,643 B1 * 2/2001 Zadok ..... 52/648.1
6,253,498 B1 * 7/2001 Fanucci ..... 52/69
6,604,328 B1 * 8/2003 Paddock ..... 52/93.1

* cited by examiner

*Primary Examiner*—Jeanette Chapman
*Assistant Examiner*—Yvonne M. Horton
(74) *Attorney, Agent, or Firm*—Richard C. Litman

(57) ABSTRACT

The unfolding modular building system includes a main floor section having a plurality of square frames having inverted pyramidal support assemblies depending therefrom, hinged corner sections defining wall frames, hinged roof support and truss sections defining gable end frames, and hinged roof panel frames, whereby an interior perimeter may be defined by the interconnection of a system components. The system is easily transported and assembled and its modular construction enables the assembly of a structure having a plurality of interconnected modular units.

8 Claims, 18 Drawing Sheets

UNFOLDING MODULAR BUILDING SYSTEM

BACKGROUND OF THE INVENTION

1. Field of the Invention

The present invention relates to prefabricated modular building assemblies, and particularly to a kit of modular building components that may be transported to a building site by a pickup truck or a trailer for erection of a building.

2. Description of the Related Art

Portable, prefabricated, foldable, and modular building structures have been developed to enable shipment of the structures in a collapsed state, thereby reducing the volume of space required for transport and avoiding the unnecessary costs of transportation of air volume within the structure.

One such structure is disclosed in U.S. Pat. No. 5,596,844, issued to J. Kalinowaki in January 1997, and includes a pre-fabricated, foldable, portable building, which, in a collapsed, folded condition, has an external shape and dimensions to fit within an envelope of an internationally standardized goods container.

U.S. Pat. No. 5,765,316, issued to Kavarsky in June 1998, discloses a modular building that is collapsible for transport and expandable for use. The '316 patent includes substantially vertical lateral and longitudinal walls and a core floor section, which, taken together, define a partially enclosed interior area. The floor assembly is connected to the core floor section for movement between folded and unfolded positions.

U.S. Pat. No. 5,950,373, issued to von Hoff et al. in September 1999, discloses a transportable structure kit having exterior panel sections adapted to attach together to form a completely enclosed transportable container. Within the container are placed a number of interior panel sections and telescoping footing sections to permanently adjust the height of the floor relative to a foundation.

U.S. Pat. No. 4,534,141, issued to G. Fagnoni in August 1985, discloses a transportable pre-fabricated building structure having an arrangement of closed longitudinal frames integral with base beams forming support and sliding runners, with a floor panel, a roof panel, and end walls, all defining a usable space. Foldable panels along lower longitudinal axes are adapted to form flooring and a roofing structure, together with panels adapted to form vertical walls for additional spaces. The panels are adapted to be supported by adjustable legs on the ground.

Similarly, U.S. Pat. No. 5,447,000, issued to P. Larson in September 1995, discloses a containerized, prefabricated building kit comprising a frame having eight corners and twelve edges.

None of the above inventions and patents, taken either singly or in combination, is seen to describe the instant invention as claimed. Thus an unfolding modular building system solving the aforementioned problems is desired.

SUMMARY OF THE INVENTION

The unfolding modular building system of the present invention has pre-built, modular structural components, which can be transported by pickup truck or trailer to difficult to reach construction sites. The building system is designed around a modular unit having a 16-foot square, 12-foot square, or 8-foot square footprint depending upon user requirements. The building may be used as a second home, a cottage, a storage facility, a garage, a pool house, or an all-around utility building, among others.

The basic modular unit includes a main floor section having a plurality of inverted pyramid shaped support assemblies forming a support frame at the foundation level, a plurality of unfolding corner-wall sections, an unfolding roof and truss support section, and an unfolding roof panel section, whereby an interior perimeter may be defined by the interconnection of a plurality of the foregoing system components. Two or more of these basic modular units may be connected together to form expanded building structures in any desired configuration. By the same token, since the modular units are composed of modular components, each modular component may be separately incorporated into a building structure of otherwise conventional construction. For example, the main floor section may be incorporated into a building having conventional wall and roof construction, or the roof and truss support section may be incorporated into a building having a convention floor and wall frame and conventional roof panels, etc. The present invention is easily transported and assembled, and the modular construction enables the assembly of a structure having a plurality of interconnected modular units.

A further embodiment of the present invention includes a folding room divider which attaches to the interior frame of the modular building and, depending upon the user preference, may partition the interior space into office space, storage space or secure space. As disclosed herein, the dividers are made of metal mesh and, alternatively, may be attached to the walls of the assembled building to provide additional security.

Accordingly, it is a principal object of the invention to provide an unfolding modular building system which is compact for shipping, easy to assemble, and, due to its modular construction, may be extended in size to meet user requirements.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
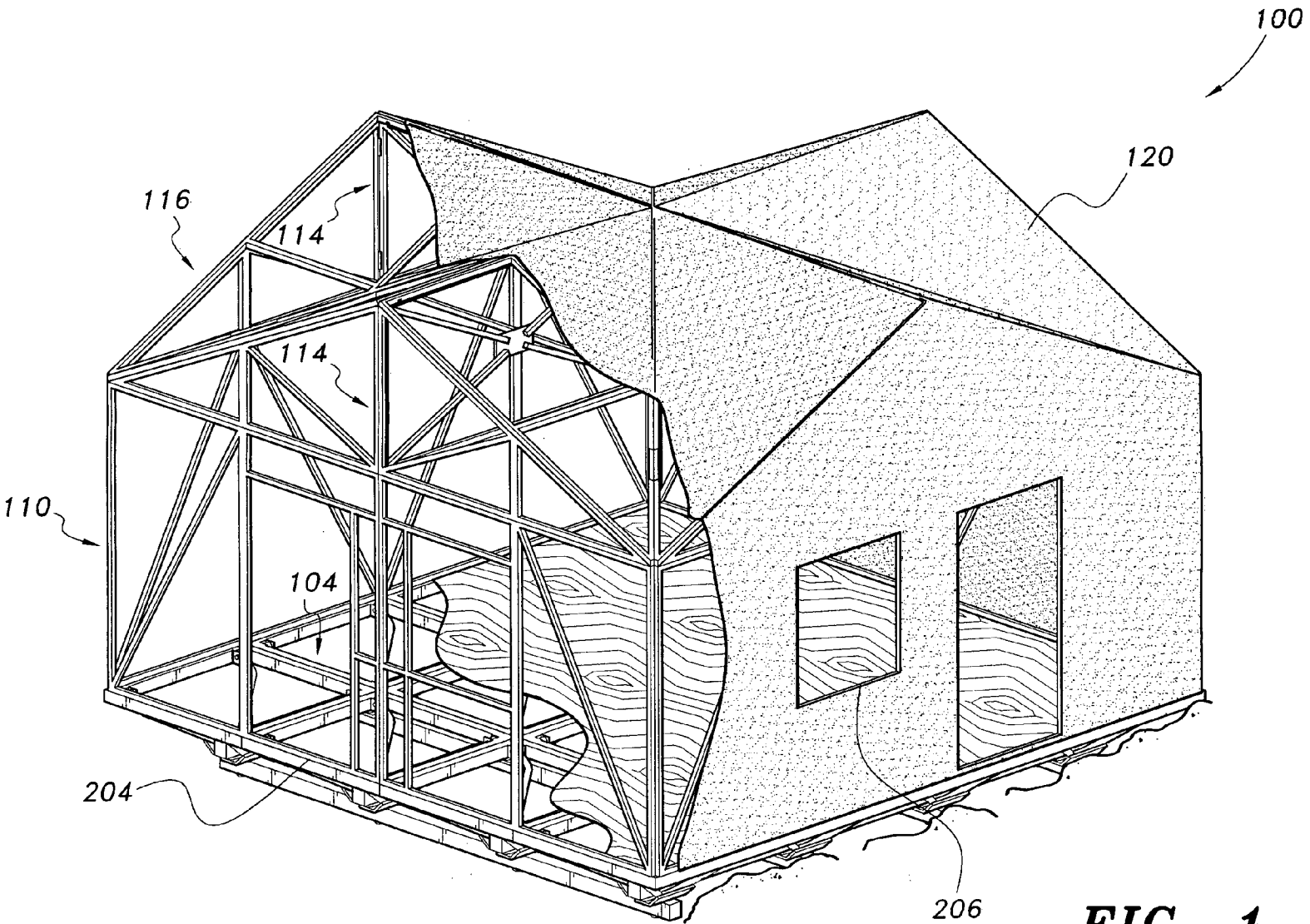
FIG. 1 is an environmental, perspective view of an unfolding modular building system according to the present invention.

The present invention is an unfolding modular building system, designated generally as 100 in the drawings. The building system 100 is comprised of pre-built modular structural components, which can be transported by pickup truck or trailer to difficult to reach construction sites. A building may be designed around a modular unit having a 16-foot square, 12-foot square, or 8-foot square footprint, although other modular unit dimensions may be used, if desired. Depending upon user requirements and the size of the building erected, the building may be used as a second home, a cottage, a storage facility, a garage, a pool house, or all-around utility facility, among others.

Figure 2:
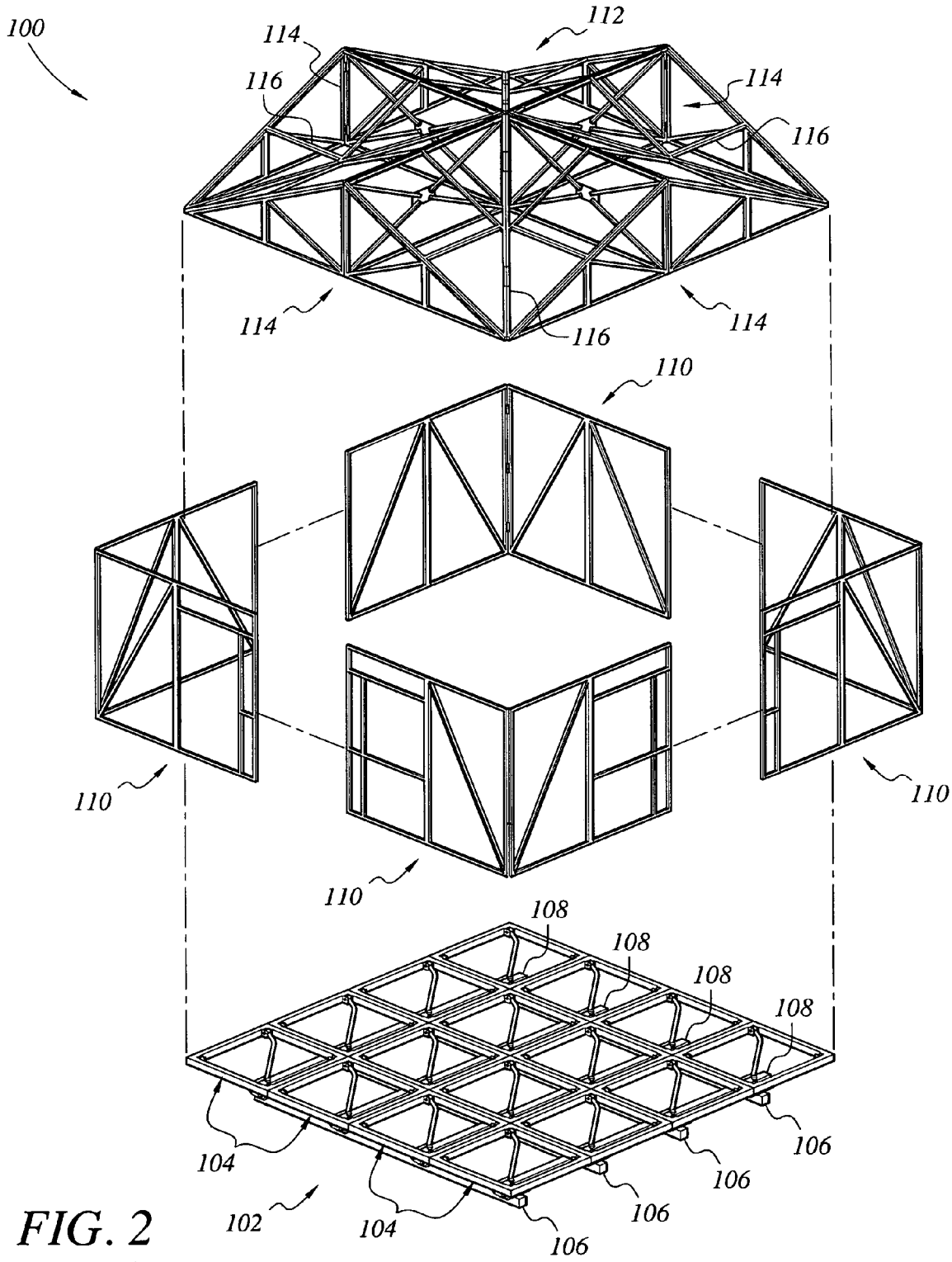
FIG. 2 is an exploded perspective view of a modular building system according to the present invention.

As shown in FIGS. 1–2, the modular system 100 is fabricated of square tubing made from aluminum, steel or other conventional tubing material, and comprises a floor structure 102, four identical unfolding corner/wall units 110, four identical unfolding roof support and truss units 114, and a roof 112 formed from four unfolding roof panel units 116. Although the preferred modular unit is square, the building erected using the present invention is not limited to a square. The modular units may be attached to each other in various patterns to create a single structure of increased square footage, but which may not be square in plan view. Furthermore, although the major components may be equipped with hinges to facilitate the assembly, the hinges are optional and may be substituted by standard mounting hardware known by those skilled in the art of construction. The floor structure 102, wall corner units 110, roof and truss supports 114, and roof panels 116 collectively form the framing of a building.

An exterior covering 120 may be bonded to the system components 110, 114, 116 either prior to shipping or after the building is assembled. The covering 120 may be waterproof if desired, and may consist of fabric, wood, bamboo, metal, fiberglass or other synthetic or natural material that is commercially available. The exterior covering 120 is bonded to the surface of the individual components using commercially available mounting hardware or adhesive. Interior paneling may be attached to the interior of the unit 100.

Figure 3:
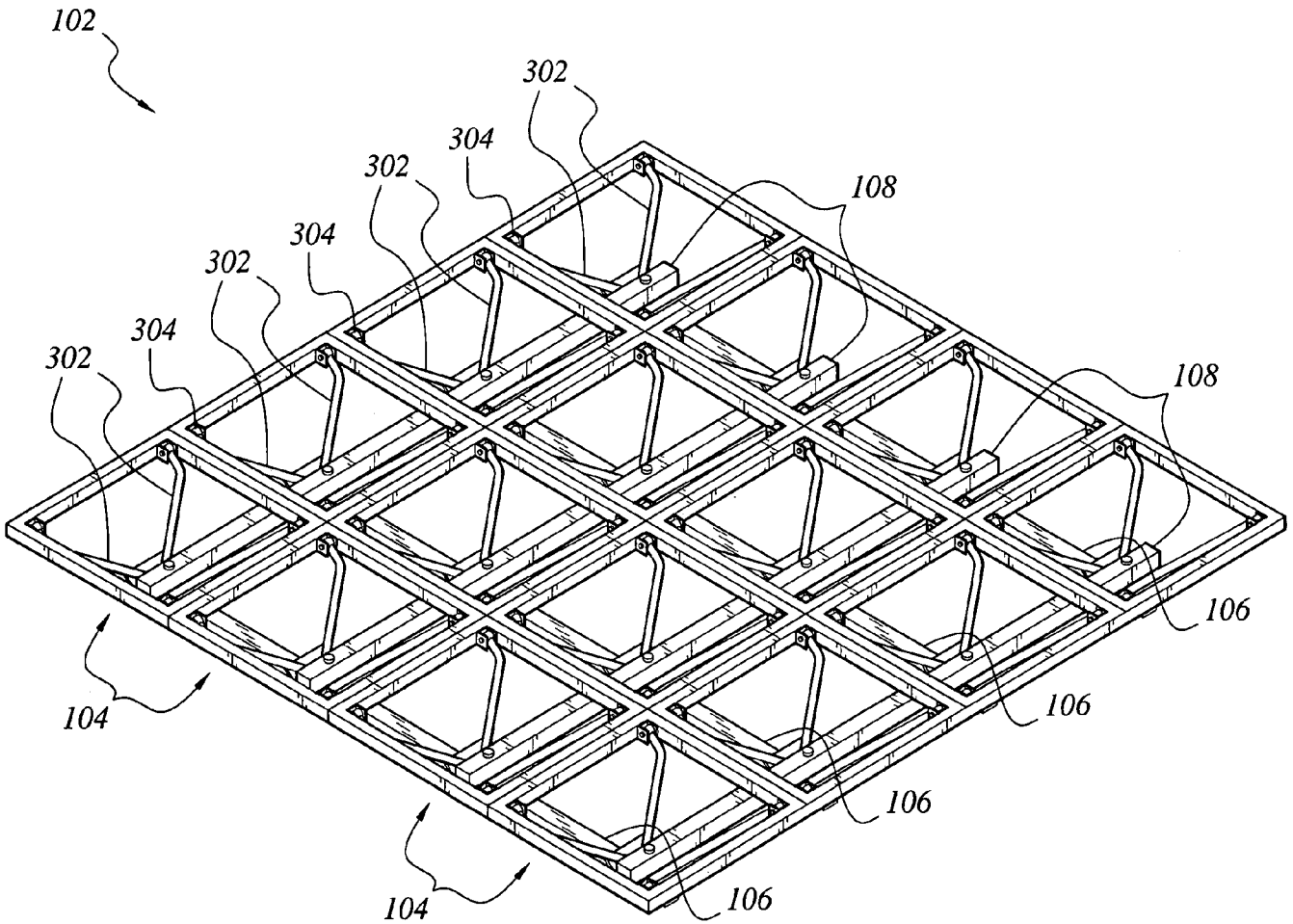
FIG. 3 is a perspective view of the main support floor of the system of the present invention.
Figure 4:
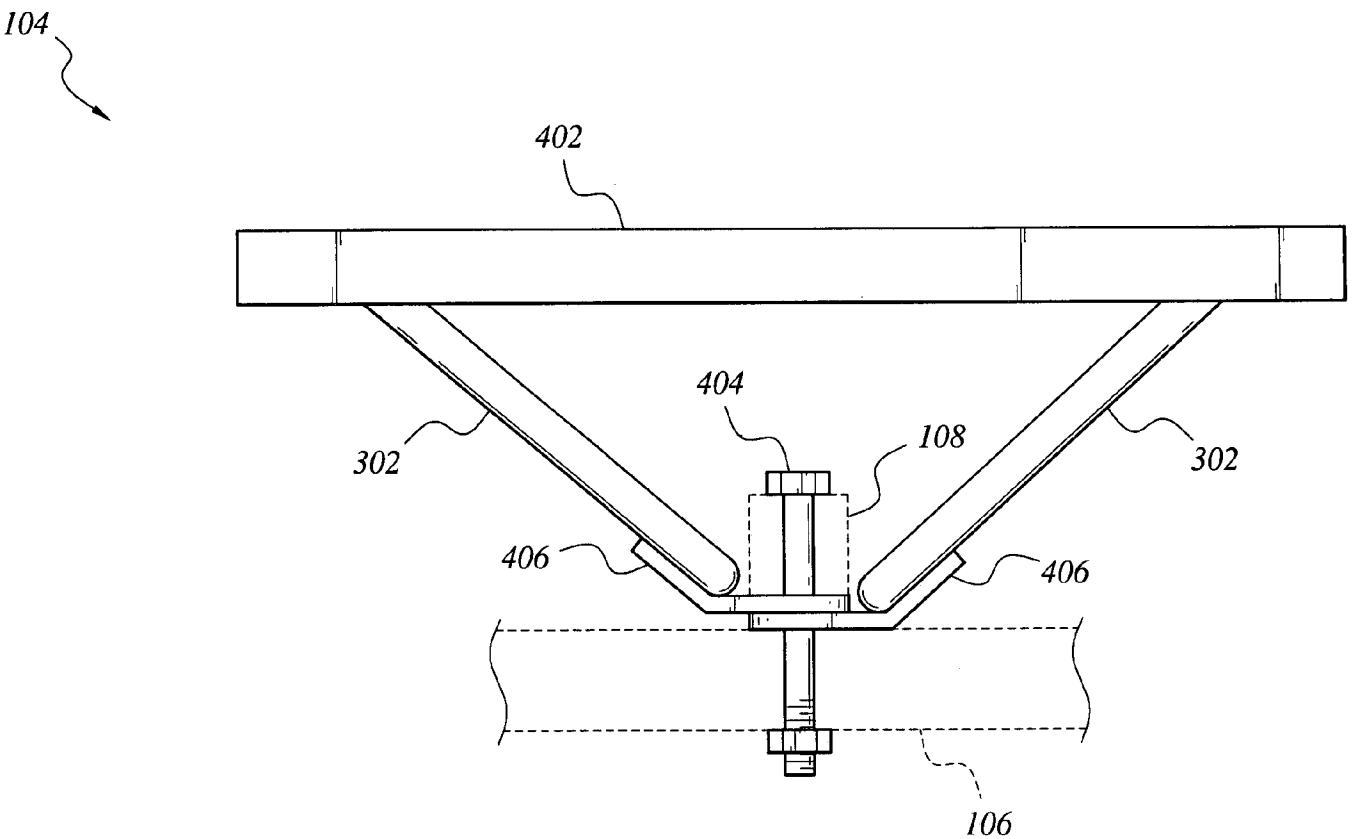
FIG. 4 is an elevation view of a single floor support assembly unit for the main support floor of FIG. 3.
Figure 5:
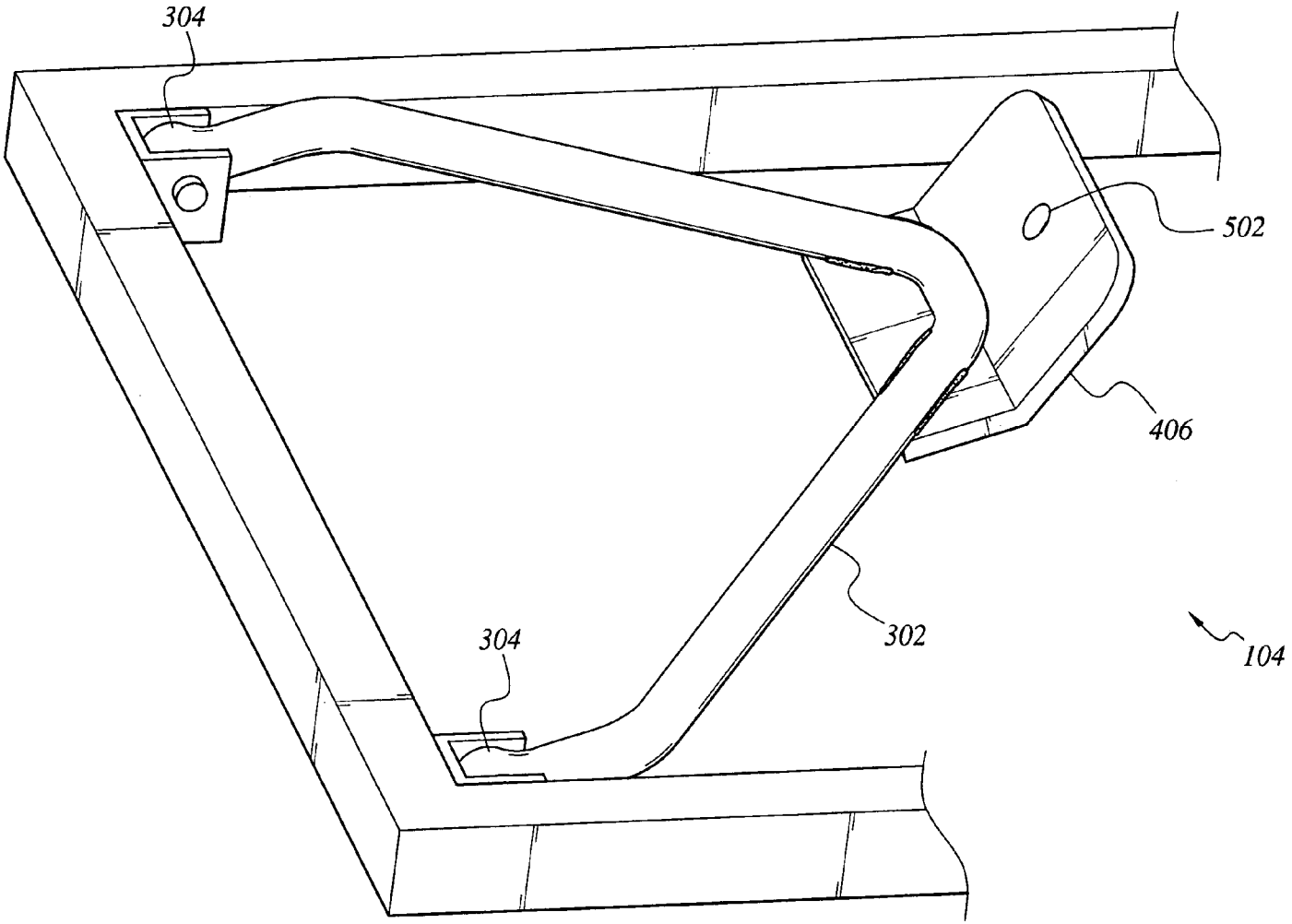
FIG. 5 is a fragmented perspective view of the floor support assembly unit of FIG. 4, showing additional detail thereof.

As shown in FIG. 2, and in greater detail in FIGS. 3–6, the floor support structure 102 is formed from an interconnected grid of square support assemblies 104. Each support assembly 104 is approximately forty-four inches square and is fabricated from square tubing. Two angled braces 302 are hinged to opposite sides of the square frame 402 and extend inward and downward from opposing sides. Each brace 302 is substantially V-shaped, having each arm pivotally attached to a corner of the square frame 402. Unlike the majority of aluminum framing which is formed from square aluminum tubing, the angled braces 302 are preferably formed of solid aluminum or steel rods having a diameter less than or equal to the length of a side of the square tubing forming the framing of the floor support assembly 104. The braces 302 are connected together at the nadir of what is basically an inverted pyramid. The nadir of the support assembly 104 may rest either on a concrete pad or on footings prepared in the surface. The two braces 302 are interconnected by means of two mounting brackets 406, welded to the midpoint of each brace 302 at the vertex of the V-shape, and held in place by bolt 404 passing through an aperture 502 defined through each mounting bracket 406. As best seen in FIGS. 3 and 4, bolt 404 affixes the nadir of each floor support assembly 104 to a lattice of rigid beams 106, 108. In the preferred embodiment, beams 106 and 108 operate to maintain the position of the grid formed by the floor support assemblies 104.

Figure 6:
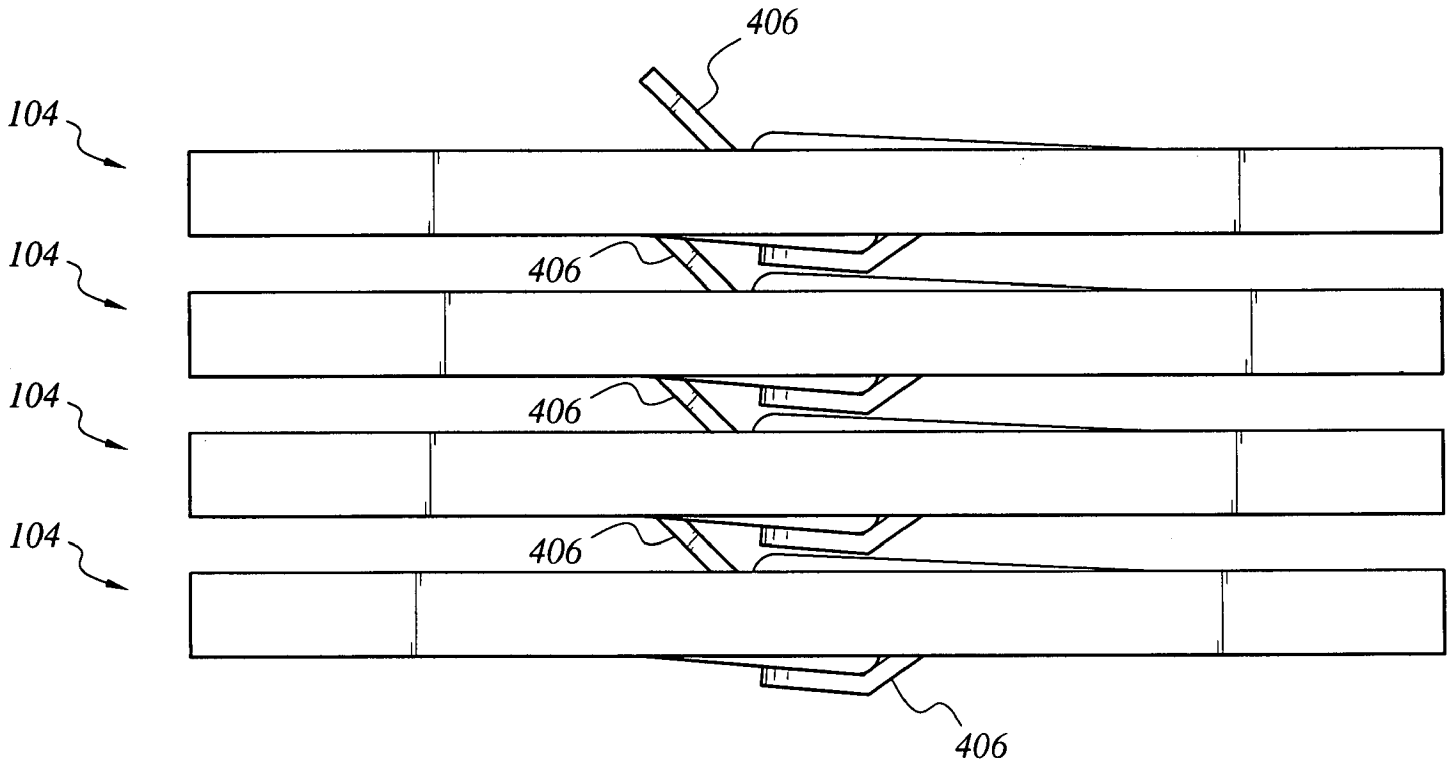
FIG. 6 is an elevation view of four floor support assembly units folded and stacked for shipping or storage.

The hinges 304 connecting the braces 302 to the frame 402 of the floor support assembly 104 enable the floor support assembly 104 to be collapsed during shipping and, as shown in FIG. 6, allows a plurality of floor support assemblies 104 to be stacked together, thereby minimizing the space required for shipping and increasing the transportability of the disassembled building system 100.

Figure 7A:
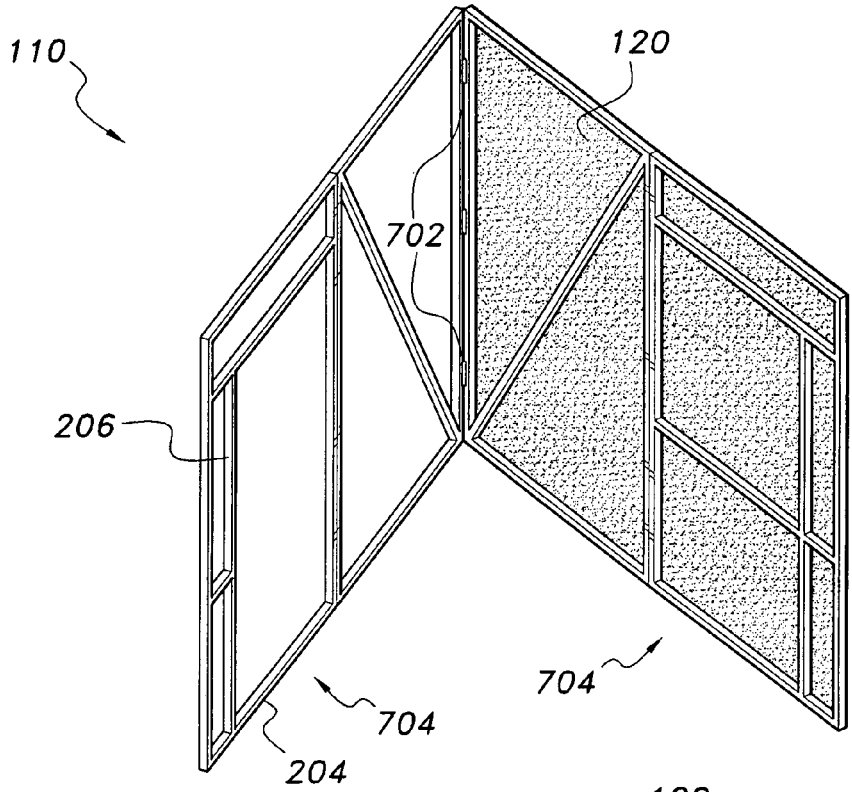
FIG. 7A is a perspective view of a folded corner section of the system of the present invention.
Figure 7B:
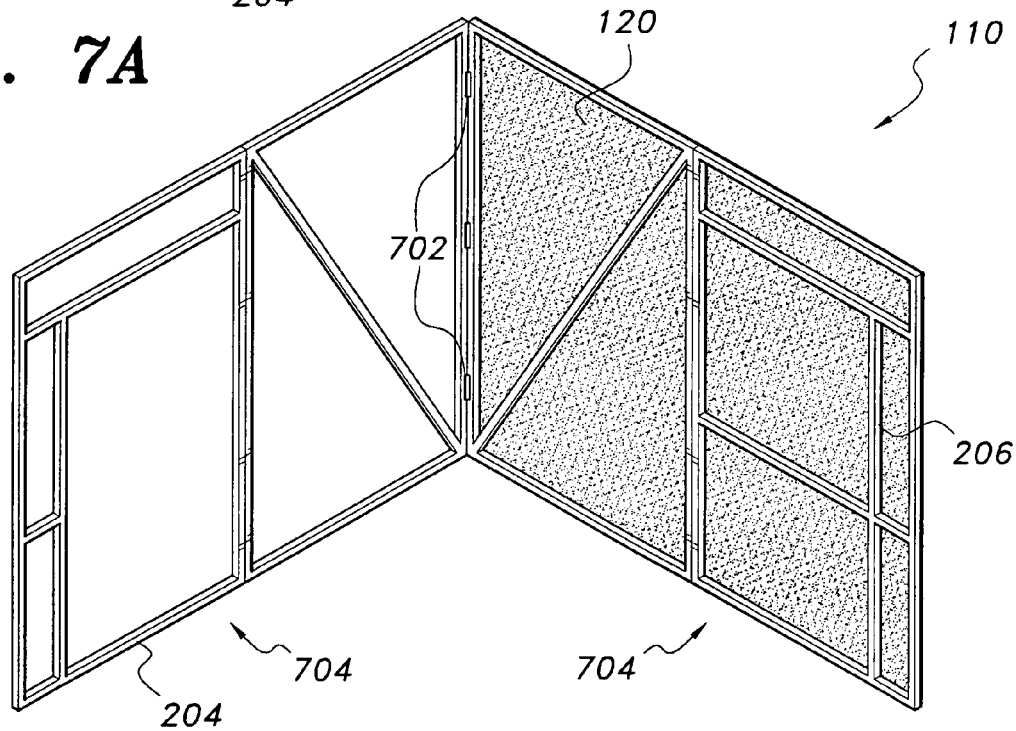
FIG. 7B is a perspective view of an unfolded corner section of the system of the present invention.

As shown in the exploded view of FIG. 2, the basic modular building 100 has four identical unfolding corner wall units 110. As best illustrated in FIGS. 7A and 7B, each corner wall unit 110 is preferably formed by a pair of square or rectangular frames 704 made from square tubing for supporting wall panels, and which are preferably hinged together by means of at least one hinge 702, thereby facilitating the assembly of the building 100. The frames 704 are designed such that a window 206 or a doorway 204 may be defined in the frame 704 by proper placement of the frame members. Hinges designed for joining rigid panels, such as those disclosed herein, are known to those skilled in the art, and the specific number of hinges as well as their placement along the perimeter of the frames 704 is determined at the time of manufacture. The frames 704 may be covered by a fabric panel, plastic panel, or metal panel covering 120, or may be left uncovered, exposing the framework within.

Figure 2A:
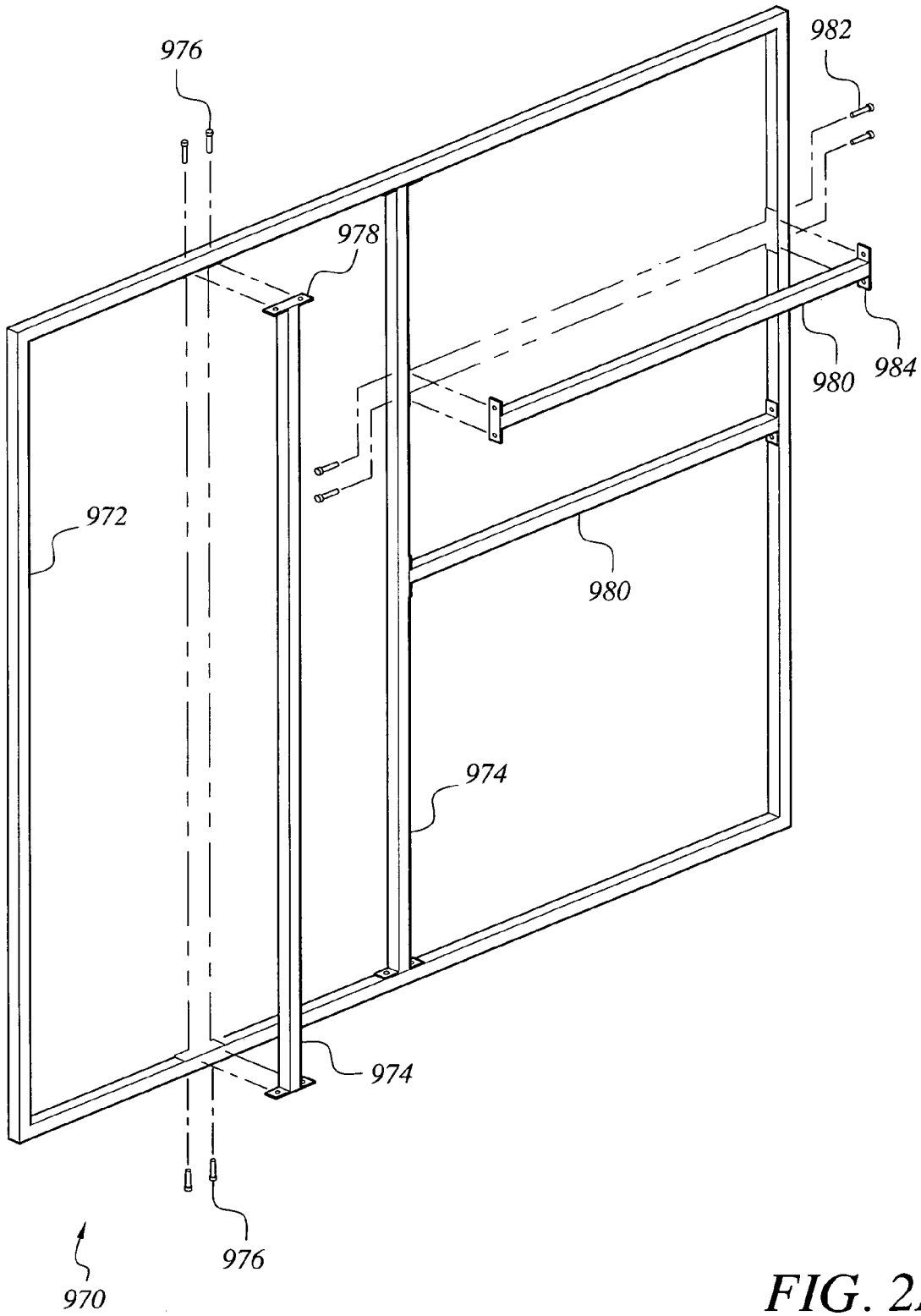
FIG. 2A is a perspective view showing an optional wall unit member of the system of the present invention

As shown in FIG. 2A, an optional wall unit member 970 may be inserted between adjacent corner/wall units 110. Wall unit member includes a rectangular frame 972 formed from tubular members, one or more posts 974 secured to the rectangular frame 972 either permanently or removably at selectable, predetermined locations and aligned vertically in order to define an opening for a patio door, garage door, or the like through fasteners 976 extending through flanges 978 at the top and bottom ends of the post 974 and the frame 972. Wall unit member 970 may also include one or more horizontal members 980 extending between the frame and at least one of the posts 974 for bracing the post 974, or for defining a window opening or other opening. Horizontal members 980 may be removably attached by fasteners 982 extending through flanges 984 at opposite ends of the member 980 and through frame 972 or post 974.

Figure 8A:
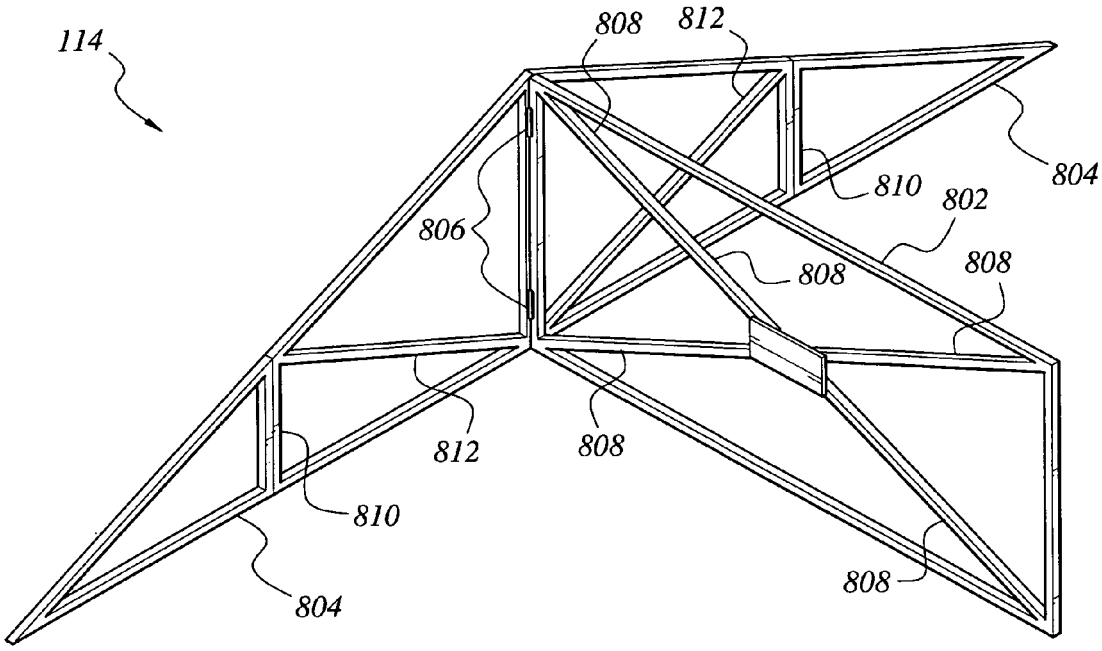
FIG. 8A is a perspective view of an unfolded roof support and truss section of the system of the present invention.
Figure 8B:
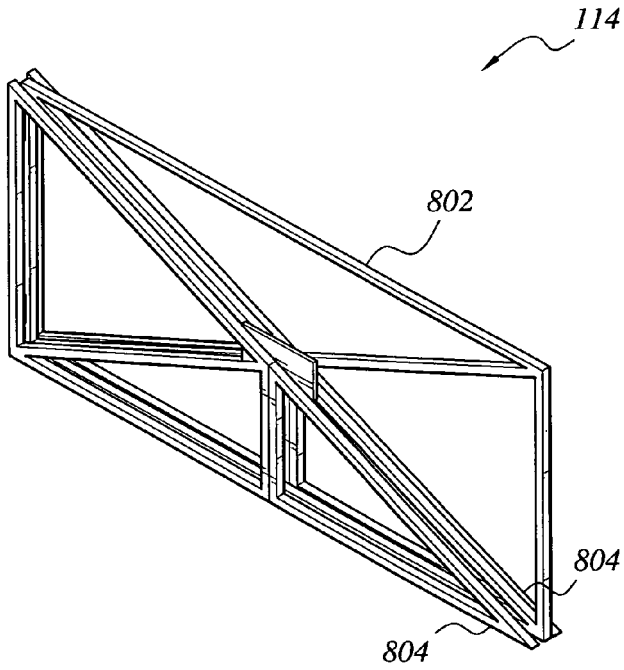
FIG. 8B is a perspective view of the roof support and truss section of FIG. 8A folded for transport and storage.
Figure 15:
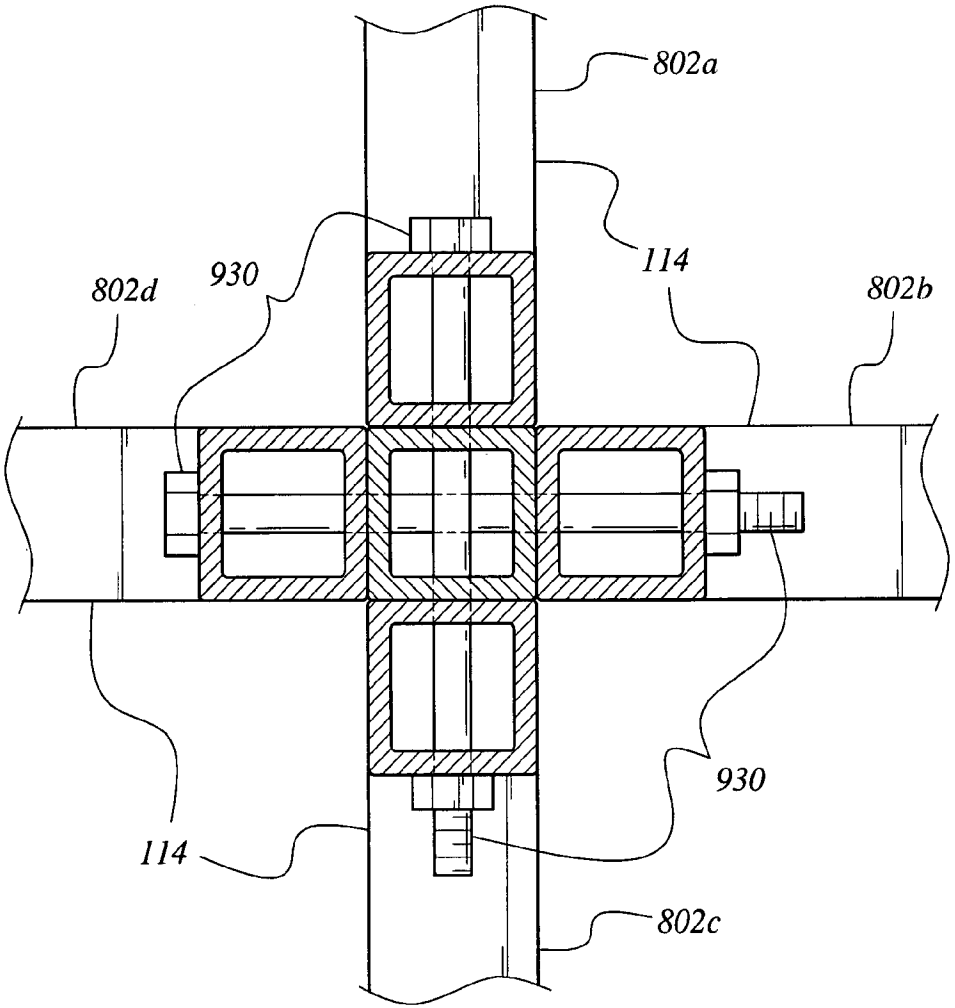
FIG. 15 is a plan view, partially in section, of the interconnection of the tops of the roof support and truss sections in the system according to the present invention.
Figure 16:
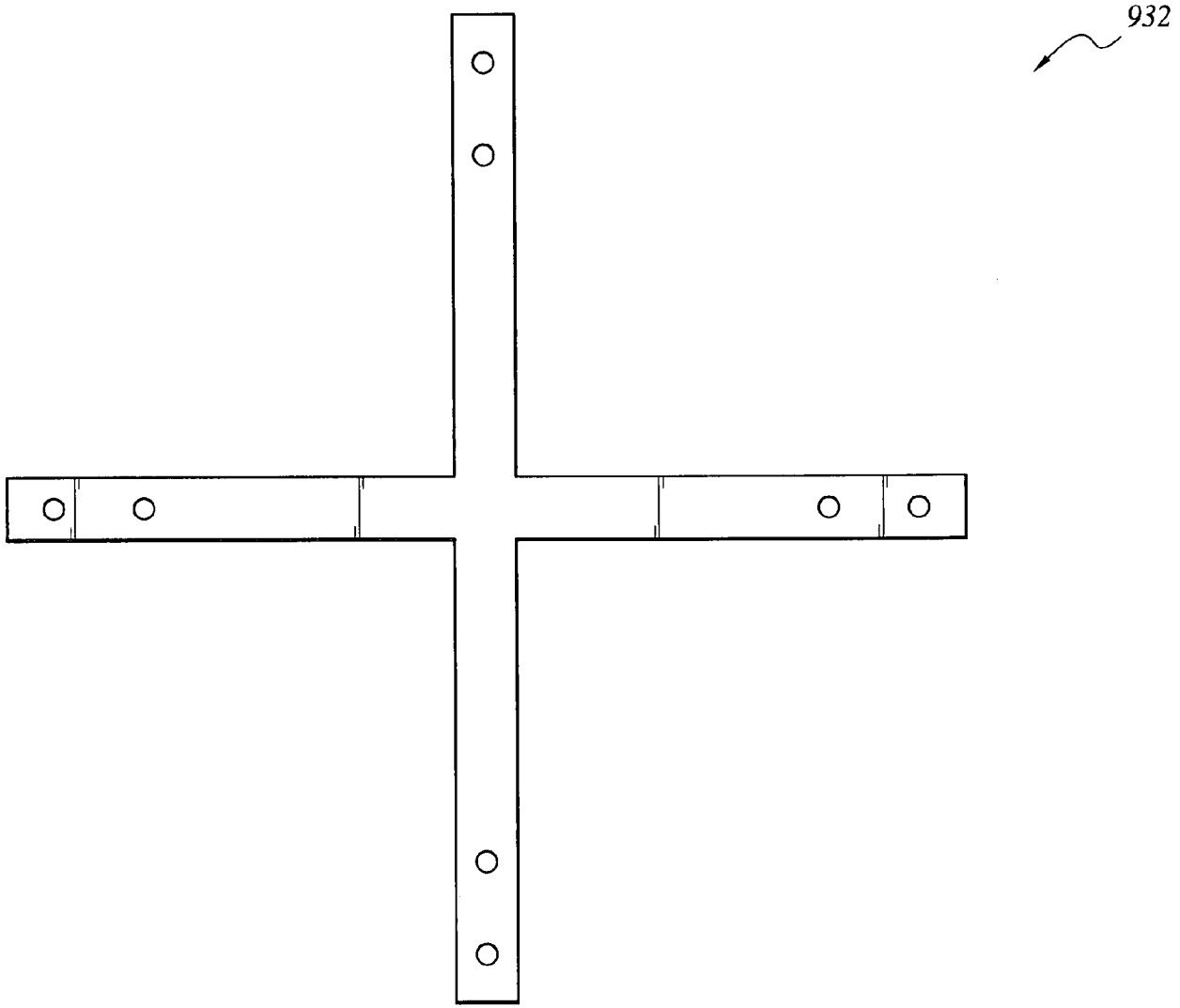
FIG. 16 is a plan view of a bracket for joining the bottom of the roof support and truss sections of the system according to the present invention.

The unfolding modular concept of the building system 100 is carried forth to the roof support and truss sections 114. As shown in FIGS. 8A and 8B, two identical triangular shaped gable end frame portions 804 are hinged to one end of a rectangular, central support frame 802 and facilitate the packing, shipping, and assembly of the modular building system 100. Both the gable end frame portions 804 and the rectangular frame 802 are formed from square tubing and have internal braces 808, 810 and 812 providing additional rigidity. As previously disclosed, the hinge 806 joining both gable end frame portions 804 to the central support frame 802 may be any suitable hinge commonly used for the purpose disclosed. The tops of the four roof support and truss sections 114, and more particularly, the free ends of central support frames 802*a*, 802*b*, 802*c*, and 802*d* are bolted together at the center of the roof, as shown in FIG. 15, with standard hardware 930, and the bottoms of the four roof support and truss sections 114 are joined by means of a cross-shaped bracket 932, shown in FIG. 16.

Figure 9A:
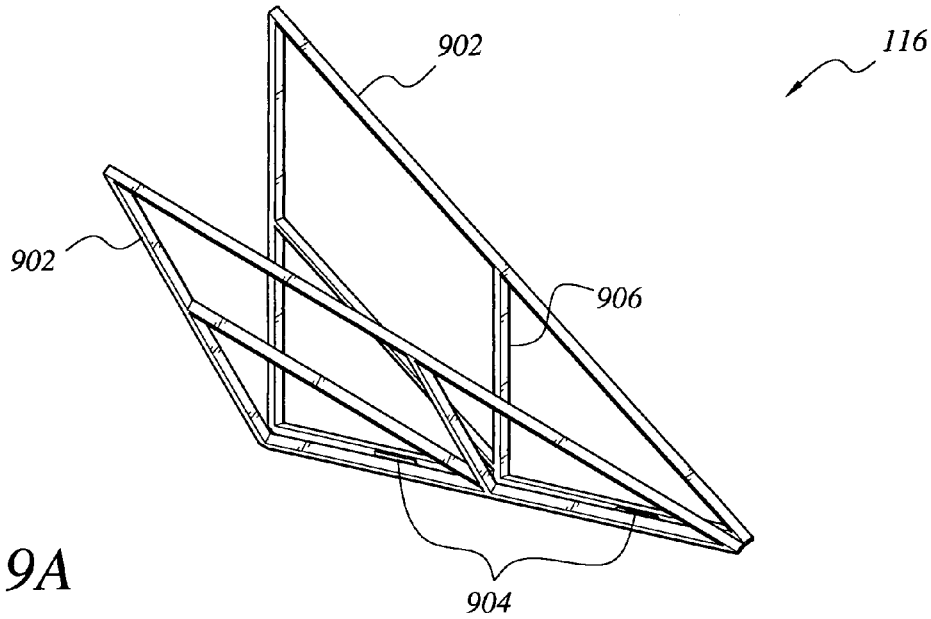
FIG. 9A is a perspective view of a folded roof panel section of the system of the present invention.
Figure 9B:
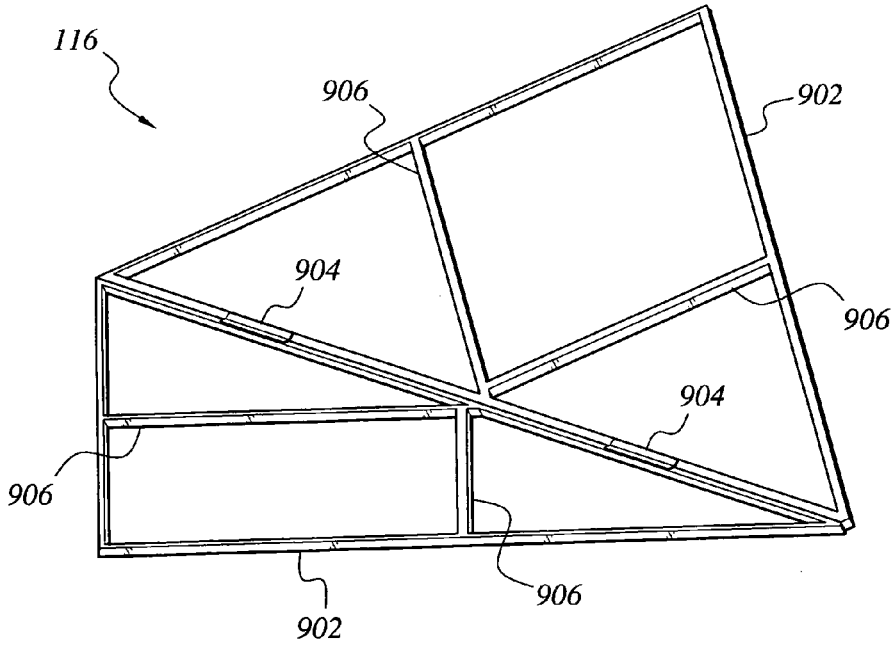
FIG. 9B is a perspective view of an unfolded roof panel section of the system of the present invention.

Similar in concept to the other system components, the folding roof panel assembly 116, shown in FIGS. 9A and 9B, is designed to facilitate shipping and assembly of the building system 100. The roof panel assembly 116 is comprised of two identical triangular-shaped frames 902 for supporting roof panels, having internal mounting brackets 906. Hinges 904, similar to the hinges 806, 702 that join the roof support and truss assemblies 114 and the corner and wall sections 110, respectively, join the two frames 902.

Figure 10:
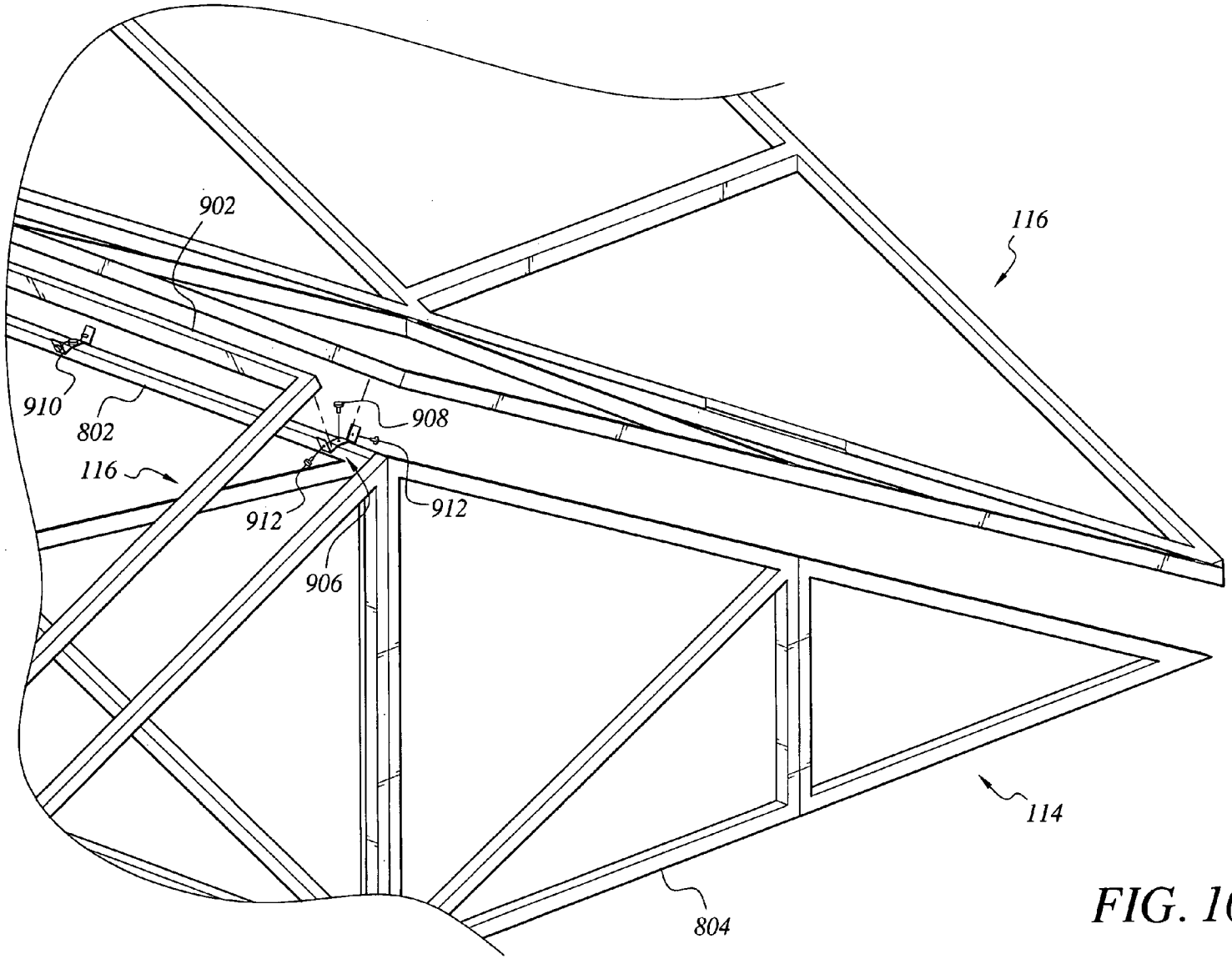
FIG. 10 is an exploded perspective view showing attachment of the roof panels to the roof support section in the system of the present invention.
Figure 11:
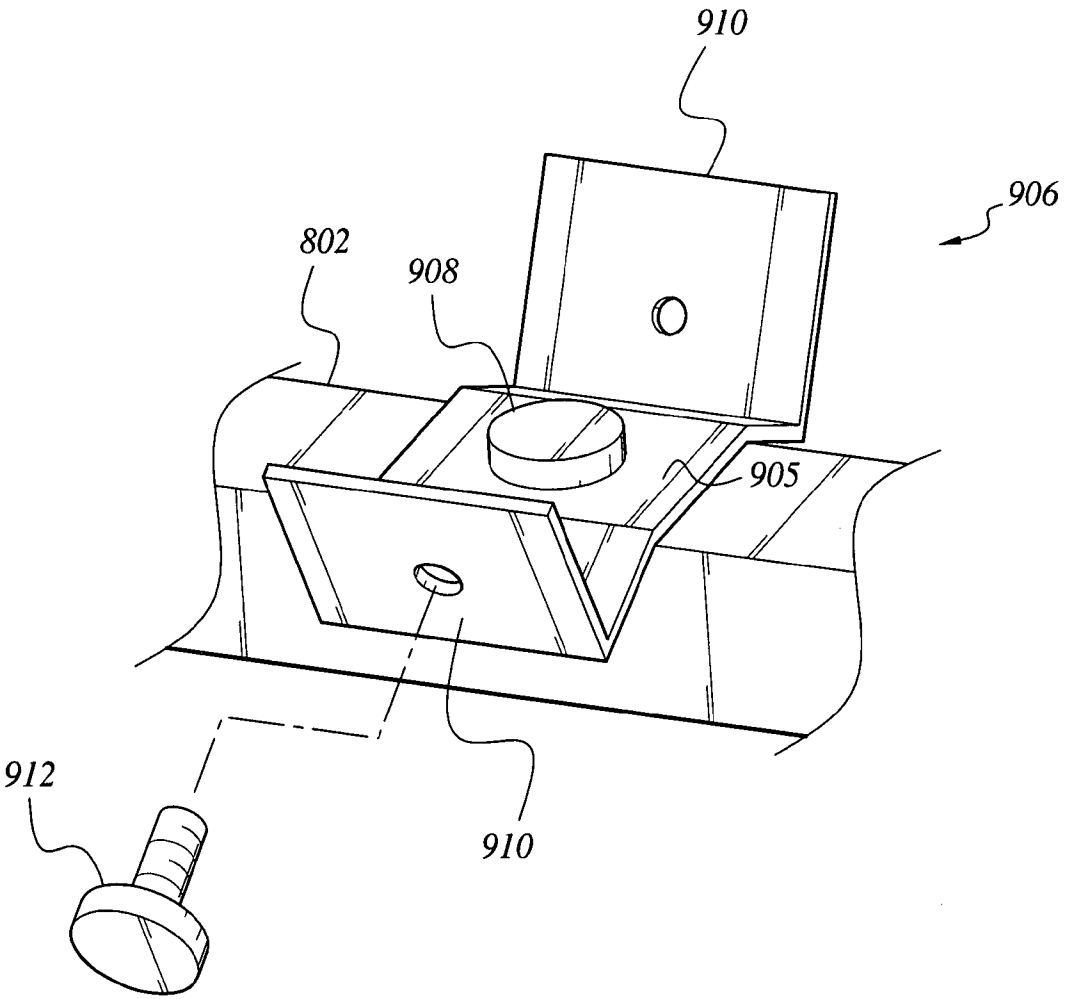
FIG. 11 is a fragmented perspective view of a roof and truss support, showing details of a roof panel bracket according to the present invention.
Figure 12:
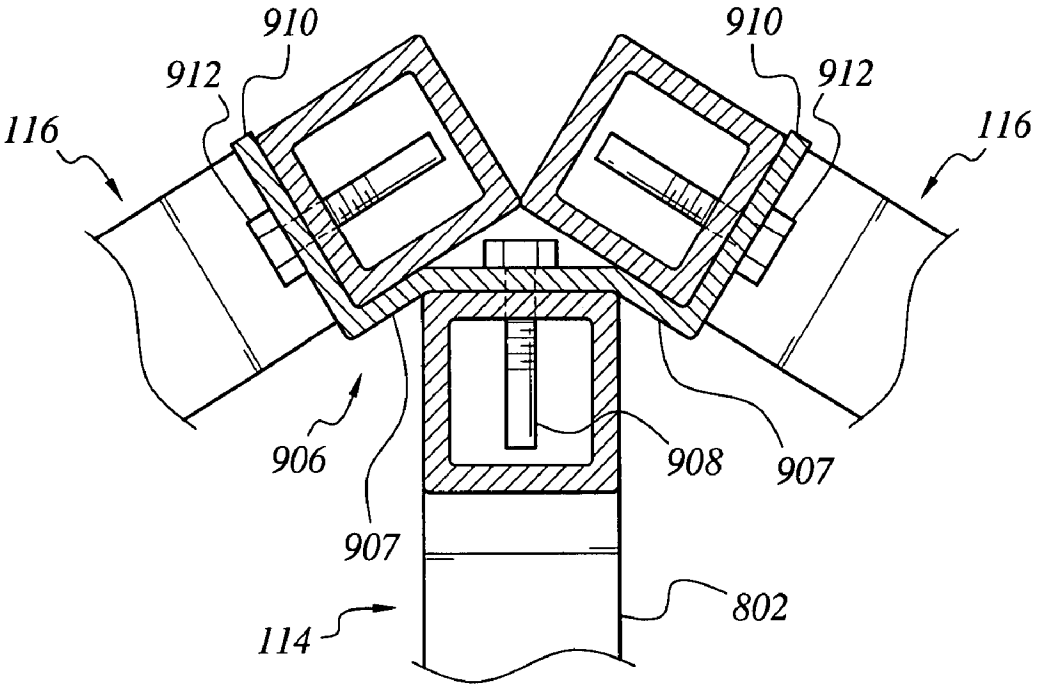
FIG. 12 is an elevation view, partially in section, showing a roof panel bracket supporting two roof panels according to the present invention.

Now referring to FIG. 10, each frame 902 of the roof panel assembly 116 is mounted to the roof support and truss assembly 114 by means of a pair of roof panel mounting brackets 906 fixed to the upper horizontal member of the central support frame 802 of the roof support and truss assembly 114. As best illustrated by the detail drawing of FIGS. 11 and 12, each roof panel mounting bracket 906 is formed from a central rectangular plate 905 of about the same width as the upper horizontal member of the central support frame 802, a pair of plates 907 extending laterally downward at an angle, and a pair of end plates 910 extending normal to the lateral plates 907. A bolt 908 attaches the bracket 906 to the upper horizontal member of central support frame 802 through an aperture cut therein. The aperture may be internally threaded, or alternatively, bolt 908 may extend through the support member 802 and be secured with a nut (not shown). Still referring to FIG. 12, a pair of roof panels 116 are received by each bracket 906, the frame 902 being supported by the lateral plate 907 and the end plate 910 and secured to the end plate by bolt 912. The downward slope of lateral plates 907 is adapted to support the frame 902 of the roof panel assembly 116 at the same angle as the downward slope of the gable end frame formed by the roof and truss assembly 114.

It will be understood that, although the system 100 has been illustrated as a four-sided building with a gable end on each side, the system 100 may be used to construct a building having any number of sides, and may have a flat roof, a single gable, or any number of gables. Two or more of these basic modular units may be connected together to form expanded building structures in any desired configuration. By the same token, since the modular units are composed of modular components, each modular component may be separately incorporated into a building structure of otherwise conventional construction. For example, the main floor section may be incorporated into a building having conventional wall and roof construction, or the roof and truss support section may be incorporated into a building having a convention floor and wall frame and conventional roof panels, etc.

Figure 13:
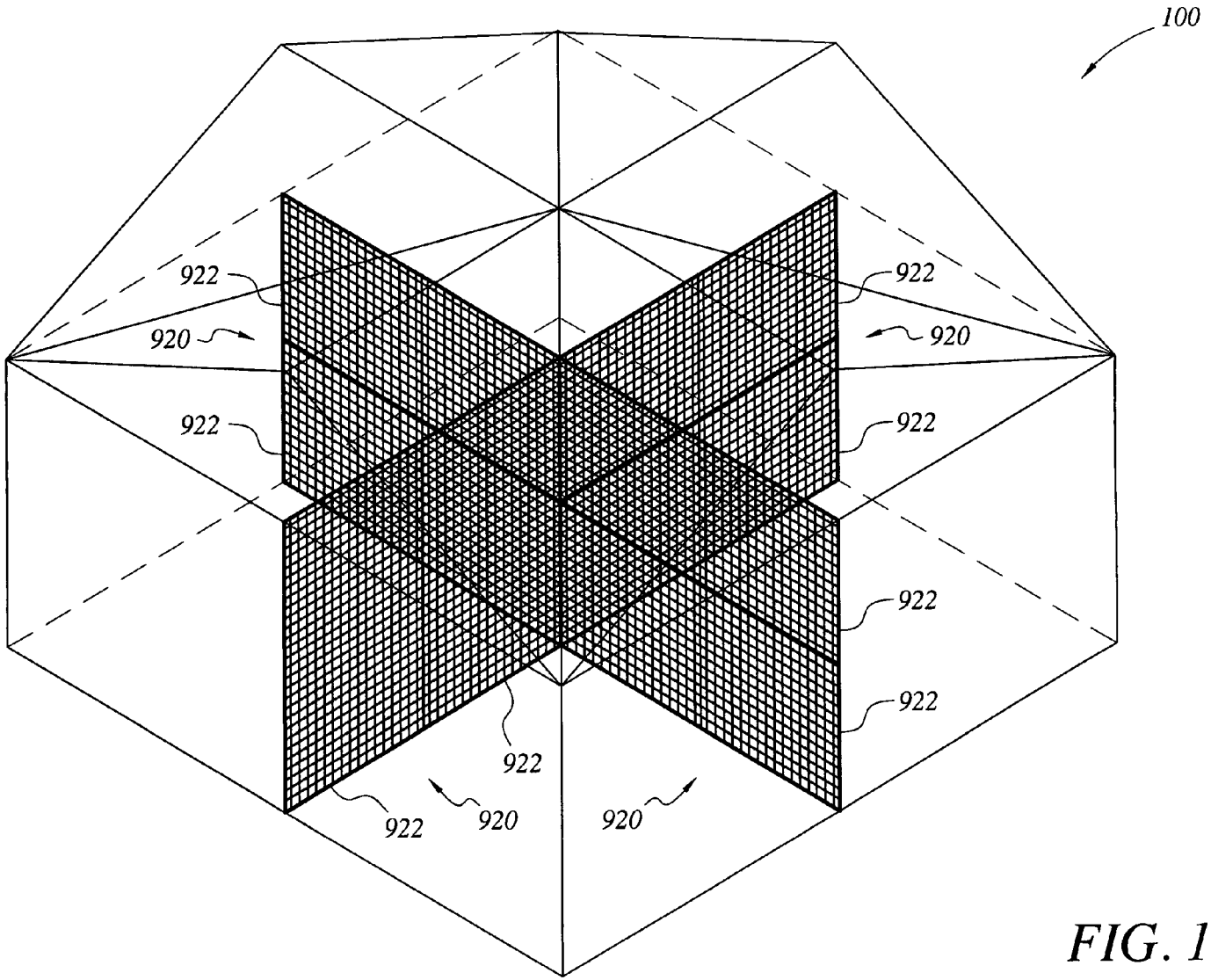
FIG. 13 is a diagrammatic perspective view of a building constructed from the modular building system according to the present invention, having dividers partitioning off the interior of the building.
Figure 14:
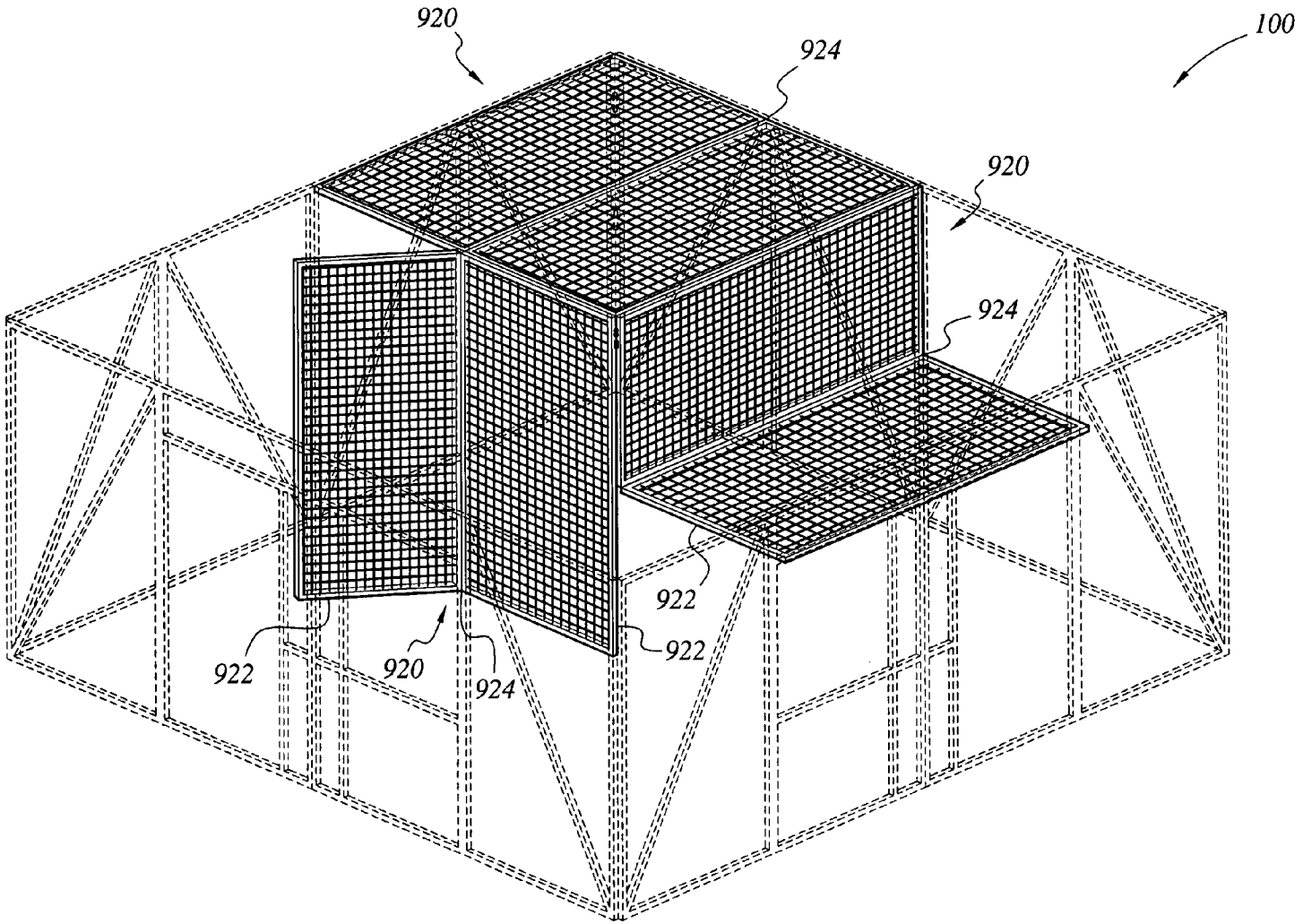
FIG. 14 is a diagrammatic perspective view of a building constructed from the modular building system according to the present invention, having foldable dividers providing a secure enclosure within the building.

An optional feature of the unfolding modular building system is shown in FIGS. 13 and 14, which shows the use of folding room dividers 920 that may be mounted either horizontally or vertically to partition off the interior space. The dividers are formed from a pair of unfolding hinged panels 922, which attach to the aluminum frame of the wall and roof support sections 110 and 114 respectively. Selective raising, lowering, and folding the panels 922 around hinges 924 results in different interior configurations. The configuration shown in FIG. 14 illustrates folding dividers 920 constructed from metal mesh and configured to provide a secure storage facility. The folding panels 922 alternately function as an access door to the partitioned area. Alternatively, the steel mesh panels may be used to reinforce the corner and wall units 110 to increase the security of the entire structure. The same kind of divider panels may also be used for exterior enclosure of the wall frame of the building.

Figure 17:
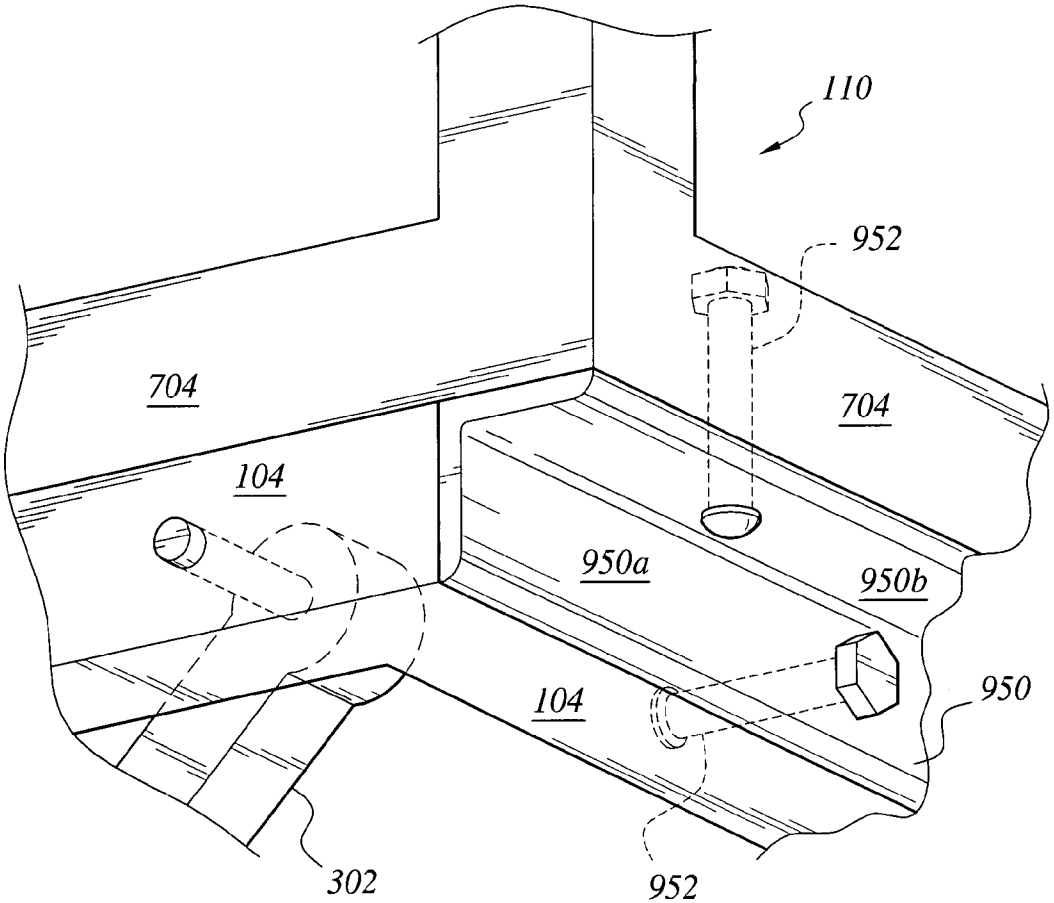
FIG. 17 is a bottom perspective view showing attachment of a floor structure to a corner/wall unit of the system of the present invention Similar reference characters denote corresponding features consistently throughout the attached drawings.

Referring to FIG. 17, the floor structure 102 may be attached to the corner/wall units 110 by elongate angles 950. The term "angles" in this context refers to a structural member often referred to as an "angle iron", made from two plates or flanges 950*a* and 950*b* of steel, aluminum, or other conventional structural material of substantially equal length and width joined at a 90° angle, being L-shaped in cross section. Bolts 952 or other fasteners at spaced intervals are used to join one flange 950*a* to the floor structure 102 and the other flange 950*b* to the corner/wall units 110. The bolts 952 may be staggered, and the bolts 952 may be installed with the bolt head abutting either the flange or the tubing forming the floor support or corner/wall unit 110. There may be only one angle 950 attached to only one frame 704 forming the corner of the corner/wall unit 110, as shown in FIG. 17, or there may be an angle attached to each of the frames 704 forming the corner of the corner/wall unit 110. The corner/wall units 110 may be attached to the roof support and truss units 114, in the same manner, or by other brackets or straps bolted to adjacent frame members.

It is to be understood that the present invention is not limited to the embodiments described above, but encompasses any and all embodiments within the scope of the following claims.

I claim:

1. A modular building system, comprising:

a basic modular unit, said basic modular unit comprising:

a main floor section comprised of at least one floor support assembly;

said at least one floor support assembly includes a square frame having a pair of V-shaped braces with each arm of each V-shaped brace pivotally attached to a corner of the square frame, said pair of V-shaped braces extending inwards and downwards from the square frame, vertices of said V-shaped braces including a pair of brackets that are bolted together at a nadir, said at least one floor support assembly defining an inverted pyramidal shape;

at least one corner section, said at least one corner section having two wall frames and at least one hinge pivotally connecting the two wall frames the at least one corner section further having a top and a bottom, the bottom of the at least one corner section being mounted to the main floor section;

at least one roof support section having two end frames and a central support frame pivotally connected together, said at least one roof support section being supported by and interconnected to the top of the at least one corner section; and at least one roof panel assembly section having two roof panel frames pivotally connected to each other, said at least one roof panel assembly section being supported by and interconnected to the at least one roof support section;

whereby an interior perimeter may be defined by said basic modular unit and two or more of said basic modular units may be connected to each other in various patterns to form an expanded building structure in any desired configuration; and wherein each of said at least one floor support assembly, said at least one corner section, said at least one roof support section, and said at least one roof panel assembly section are foldable for transport and storage, and may be unfolded for assembly.

2. The modular building system according to claim 1, further comprising at least one security divider having at least two divider panels and a hinge pivotally connecting the two divider panels, the folding security divider being removably disposed between the floor section and the roof support section in order to partition an interior defined by the modular unit.

3. The modular building system according to claim 2, wherein each of the divider panels is made of a metallic mesh.

4. The modular building system according to claim 1, wherein each roof panel frame comprises a triangular frame formed from square tubing.

5. The modular building system according to claim 1, further comprising a plurality of roof panel mounting brackets attached to the central support frame of said roof support section, each of the roof panel mounting brackets having a center plate, a pair of downward sloping lateral plates extending from opposite sides of the center plate, and an end plate extending normal to each of the lateral plates, each roof panel frame having a side supported by the lateral and end plate of at least one of said roof panel mounting brackets.

6. The modular building system according to claim 1, further comprising an exterior covering attached to each of the sections.

7. The modular building system according to claim 1, wherein said main floor support section, said at least one corner section, said at least one roof support section, and said at least one roof panel assembly section are each made from square tubing forming frame sections attached by hinges.

8. The modular building system according to claim 1, wherein the two end frames of the at least one roof support section are a pair of identical, triangular shaped gable end frame portions, each triangular gable end frame portion including internal braces; and said central support frame of the at least one roof support section is a rectangular central support frame that includes internal braces;

wherein each of said triangular shaped gable end frame portions are hinged to one end of the rectangular central support frame to facilitate packing, shipping and assembly.

* * * * *